US009815181B2

(12) United States Patent
Yang

(10) Patent No.: US 9,815,181 B2
(45) Date of Patent: Nov. 14, 2017

(54) MANUAL SCREWDRIVER

(71) Applicant: MiiCs & Partners (Shenzhen) Co., Ltd, Shenzhen (CN)

(72) Inventor: Guang Yang, Shenzhen (CN)

(73) Assignee: MiiCs & Partners (Shenzhen) Co., Ltd., Shenzhen (CN)

( * ) Notice: Subject to any disclaimer, the term of this patent is extended or adjusted under 35 U.S.C. 154(b) by 311 days.

(21) Appl. No.: 14/573,822

(22) Filed: Dec. 17, 2014

(65) Prior Publication Data

US 2016/0129566 A1 May 12, 2016

(30) Foreign Application Priority Data

Nov. 12, 2014 (CN) ..... 2014 1 0633879

(51) Int. Cl.
*B25B 15/06* (2006.01)

(52) U.S. Cl.
CPC ..... *B25B 15/06* (2013.01)

(58) Field of Classification Search
CPC ..... B25B 23/0035; B25B 15/04; B25B 17/00; B25B 15/02; B25B 15/00; B25B 15/06
See application file for complete search history.

(56) References Cited

U.S. PATENT DOCUMENTS 2,947,334 A * 8/1960 Issartel ..... B23B 45/06 74/127
4,577,522 A * 3/1986 Cox, Jr. ..... B25B 15/06 74/127

* cited by examiner

*Primary Examiner* — Robert Scruggs
(74) *Attorney, Agent, or Firm* — Steven Reiss

(57) ABSTRACT

A manual screwdriver includes a handle defining a cavity and a slot, a screwdriver head at one end of the handle, a rotation connector rotatably received in the cavity, a spiral rod defining a spiral groove and being rotatably received in the cavity, an operating arm slidably received in the spiral groove with two ends of the operating arm extending from the cavity through the slot, and a first elastic element biased on the operating arm. The screwdriver head is connected to the handle via the rotation connector. The spiral rod can be driven by the operating arm to engage or disengage the rotation connector. When the spiral rod and the rotation connector are combined into an engaged state, the operating arm can slide in the spiral groove toward the screwdriver head to drive the spiral rod and the rotation connector to rotate relative to the handle.

16 Claims, 6 Drawing Sheets

MANUAL SCREWDRIVER

FIELD

The subject matter herein generally relates to a screwdriver, and particularly to a labor-saving manual screwdriver.

BACKGROUND

In the machine field, a screwdriver can be applied to lock fasteners such as screw bolts onto a target object. A traditional screwdriver usually includes a handle and a screwdriver head fixed onto one of two ends of the handle. In operation, the user applies a torque onto the handle to drive the screwdriver head to rotate about an axis of rotation. However, applying the torque manually is labor-consuming and not convenient.

BRIEF DESCRIPTION OF THE DRAWINGS

Implementations of the present technology will now be described, by way of example only, with reference to the attached figures.

DETAILED DESCRIPTION

Figure 1:
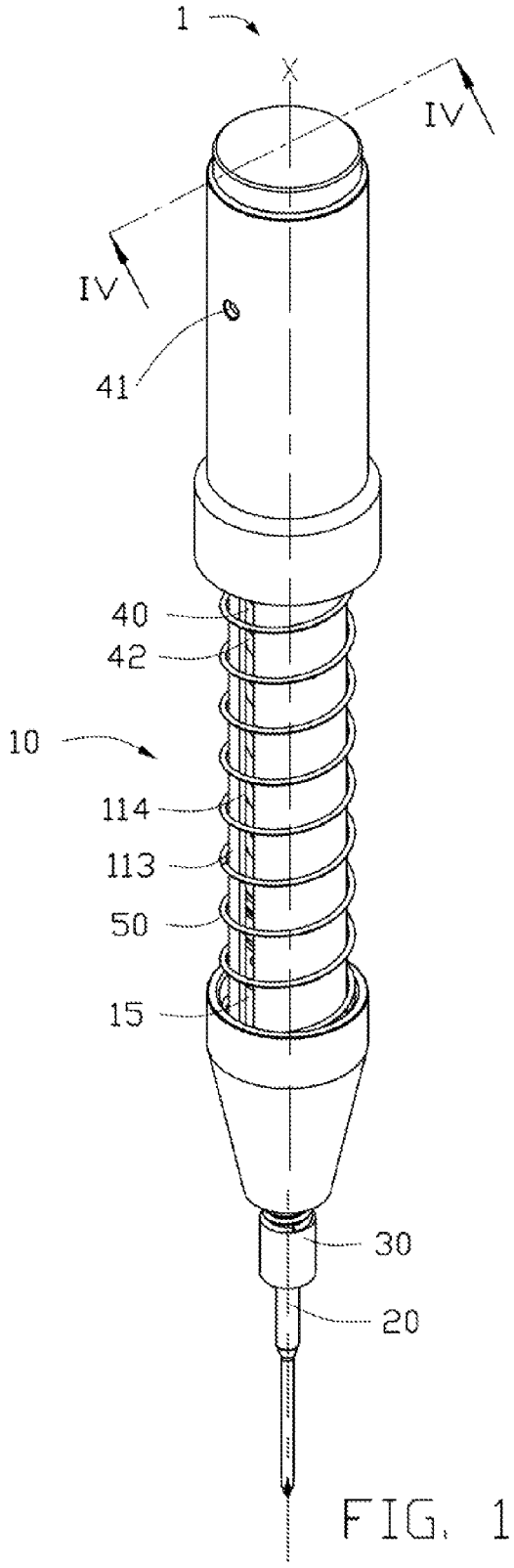
FIG. 1 is an assembled view of the manual screwdriver in accordance with an exemplary embodiment of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "exterior" refers to a region that is beyond the outermost confines of a physical object. The term "interior" indicates that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

The present disclosure is described in relation to a screwdriver, and particularly to a labor-saving manual screwdriver.

FIG. 1 illustrates a manual screwdriver 1 in accordance with an exemplary embodiment of the present disclosure. The manual screwdriver 1 includes a handle 10 defining a cavity 15 and a slot 114 communicating the cavity 15 to exterior space, a screwdriver head 20 at one end of the handle 10, a rotation connector 30 rotatably received in the cavity 15, a spiral rod 40 defining a spiral groove 42 and being rotatably received in the cavity 15, an operating arm 41 slidably received in the spiral groove 42 with two opposite ends of the operating arm 41 extending from the cavity 15 through the slot 114, and a first elastic element 50 connecting the operating arm 41 to the handle 10. The screwdriver head 20 is connected to the handle 10 via the rotation connector 30.

The spiral rod 40 can be driven by the operating arm 41 to engage or disengage the rotation connector 30. When the spiral rod 40 and the rotation connector 30 are combined together into an engaged state, the operating arm 41 can slide toward the screwdriver head 20 in the spiral groove 42 to drive the spiral rod 40 and the rotation connector 30 to rotate about an axis X of rotation with respect to the handle 10, thereby enabling the screwdriver head 20 to synchronously and circularly rotate with the rotation connector 30.

Figure 2:
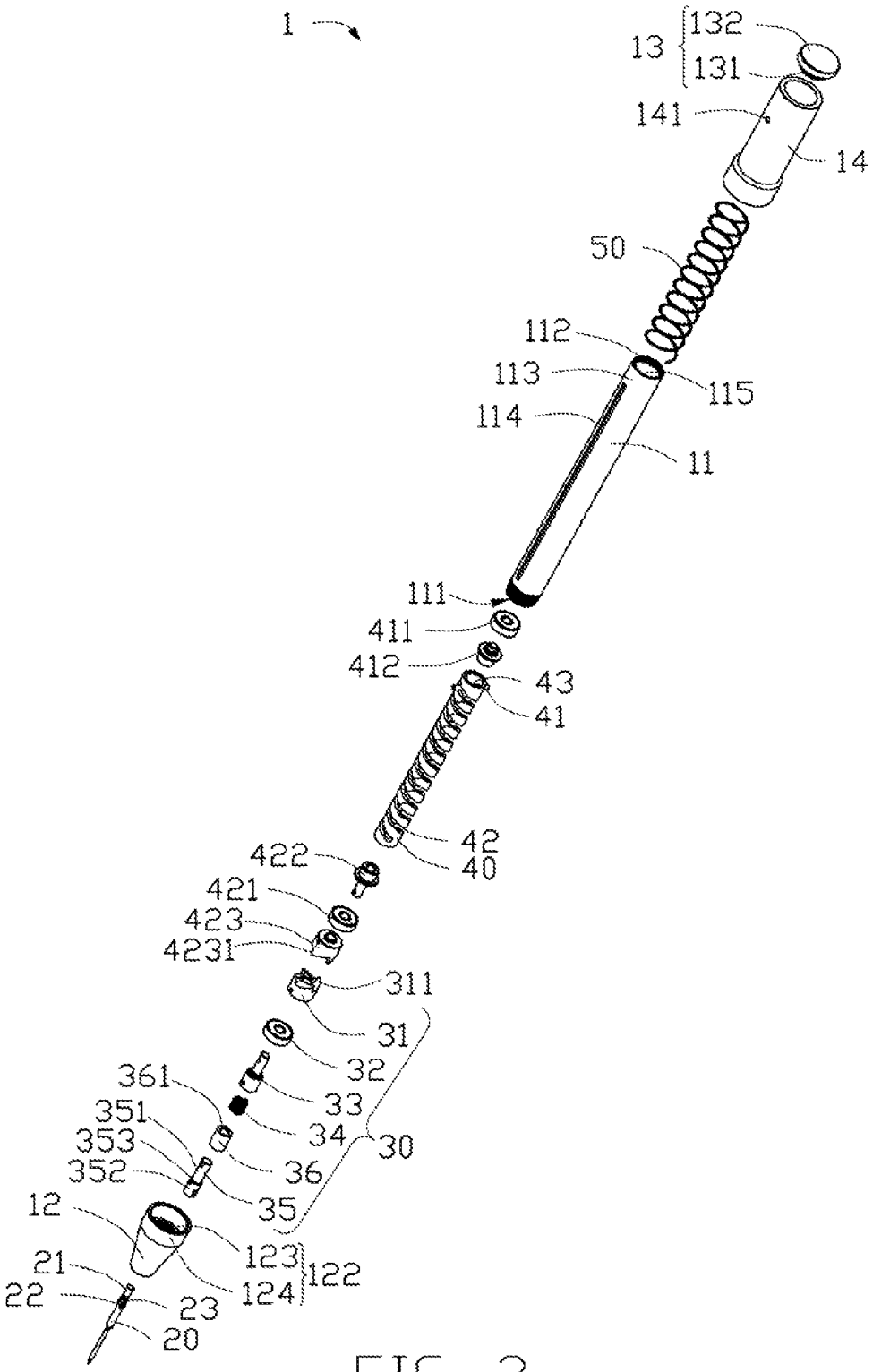
FIG. 2 is an exploded view of the manual screwdriver of FIG. 1.
Figure 3:
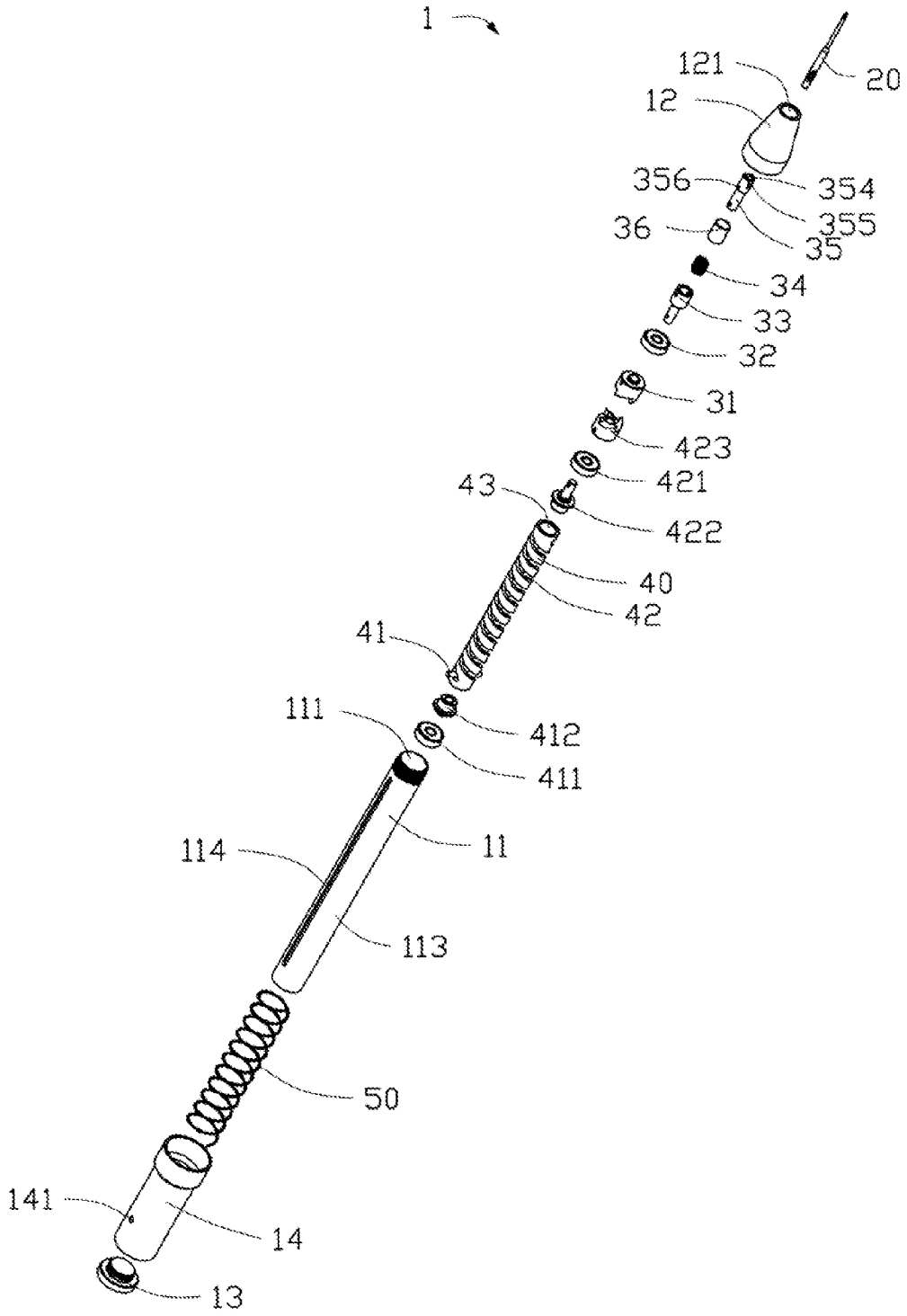
FIG. 3 is similar to FIG. 2, but viewed from a different angle.

FIGS. 2 and 3 illustrate an exploded view of the manual screwdriver 1. The handle 10 of the manual screwdriver 1 includes an elongated first main body 11, a cap 12 and a rear cover 13 at opposite ends of the first main body 11, and a bush 14 coupled to the first main body 11.

The first main body 11 is tubular. The first main body 11 defines an interior space 115 for receiving the spiral rod 40. The first main body 11 has two openings 111 and 112 at opposite ends for communicating the interior space 115 to exterior space. The first main body 11 and the cap 12 are connected via screw threads. The first main body 11 and the rear cover 13 are also connected via screw threads. Alternatively, the first main body 11 can be releasably connected to the cap 12 and the rear cover 13 by fasteners, couplers and the like.

The slot 114 defines on an outer wall 113 of the first main body 11. The slot 114 is configured to prevent rotation movement of the operating arm 41 in the slot 114. The slot 114 is linear and extends along a direction parallel to the axis X of rotation (see FIG. 1). A length of the slot 114 is less than that of the first main body 11. In the present embodiment, there are two slots 114 being symmetrically located on the outer wall 113 with respect to the axis X of rotation.

The cap 12 is a frustum of cone. An outer diameter of the cap 12 increases as it extends towards the first main body 11. The cap 12 defines a through hole 121 which axially extends through opposite ends of the cap 12.

The cap 12 also defines a barrier 122 adjacent to the first main body 11. The barrier 122 includes an annular engaging surface 123 and a circular fence 124 axially extending from an outer periphery of the engaging surface 123 toward the rear cover 13.

An inner diameter of the engaging surface 123 is substantially equal to an outer diameter of the first main body 11. The end surface of the first main body 11 situated at the opening 111 has outer screw threads (not labeled) thereon. The cap 12 has inner screw threads (not labeled) situated on the inner surface and corresponding to the outer screw threads on the end surface of the first main body 11.

The rear cover 13 includes a shaft portion 131 and an enlarged head portion 132 connected to the shaft portion 131. The shaft portion 131 defines outer screw threads thereon.

The bush 14 is sleeved onto the outer wall 113 of the first main body 11. The bush 14 defines two insertion holes 141 on the wall for respectively receiving two opposite ends of the operating arm 41 which extend from the cavity 15. The first elastic element 50 is to be interposed between the bush 14 and the barrier 122 of the cap 12.

The spiral rod 40 is a hollow cylinder. An outer diameter of the spiral rod 40 is smaller than an inner diameter of the first main body 11. A length of the spiral rod 40 is less than a length of the first main body 11. The spiral rod 40 is made of rigid materials such as rolled steel or other rigid metals for reinforcing the strength thereof.

The spiral rod 40 defines a channel 43 therein. The spiral groove 42 surrounds the channel 43 and spirally extends from one of two ends of the spiral rod 40 towards the other end of the spiral rod 40. Namely, the spiral groove 42 is disposed to be inclined to the axis X of rotation (see FIG. 1). In detail, an intersection angle between the spiral groove 42 and the axis X of rotation is an acute angle.

The spiral rod 40 further includes a first bearing 411 and a second bearing 421 at opposite ends thereof. The first bearing 411 and the second bearing 421 are connected to the opposite ends of the spiral rod 40 via a first connecting pin 412 and a second connecting pin 422, respectively. The first bearing 411 and the second bearing 421 can enable the spiral rod 40 and the first main body 11 to be coaxially aligned to each other.

The spiral rod 40 has a second ratchet 423 at the end adjacent to the cap 12. The second ratchet 423 has a plurality of teeth 4231 facing the cap 12. The second ratchet 423 is connected to the spiral rod 40 via the second connecting pin 422. The second bearing 421 is engaged between the second ratchet 423 and the second connecting pin 422.

The rotation connector 30 includes a first ratchet 31, a third bearing 32, a third connecting pin 33, a second elastic element 34, a fourth connecting pin 35, and a snap ring 36.

The first ratchet 31 of the rotation connector 30 faces the second ratchet 423 of the spiral rod 40. The first ratchet 31 has a plurality of teeth 311 corresponding to the plurality of teeth 4231 of the second ratchet 423. The plurality of teeth 311 of the first ratchet 31 engages the plurality of teeth 4231 of the second ratchet 423 to prevent sliding movement between the spiral rod 40 and the rotation connector 30 when the spiral rod 40 and the rotation connector 30 are brought into an engaged state.

The third connecting pin 33 passes through the third bearing 32 to be releasably connected to the first ratchet 31. The fourth connecting pin 35 is interposed between the screwdriver head 20 and the third connecting pin 33.

The fourth connecting pin 35 includes an elongated shaft portion 351 and an enlarged head portion 352 connected to the shaft portion 351. The enlarger head portion 352 has an increased diameter than that of the shaft portion 351. A step 353 is defined between the shaft portion 351 and the enlarged head portion 352.

The screwdriver head 20 is rod-shaped. The screwdriver head 20 has two protruded ears 22 extending radial outward from the middle thereof. The screwdriver head 20 defines two recessed neck portions 23 between the protruded ears 22 and an end 21 of the screwdriver head 20. The two recessed neck portions 23 each have a decreased diameter than that of the remaining portion of the screwdriver head 20.

The head portion 352 of the fourth connecting pin 35 defines a recess 354 for accommodating the end 21 of the screwdriver head 20. The recess 354 defines two slits 355 for respectively receiving the protruded ears 22, so as to prevent rotation movement between the screwdriver head 20 and the fourth connecting pin 35 when assembled. The fourth connecting pin 35 also defines two connecting holes 356 corresponding to the two recessed neck portions 23 of the screwdriver head 20.

The snap ring 36 defines an annular baffle 361 extending radially inward from one end periphery thereof. An inner diameter of the baffle 361 is substantially equal to an outer diameter of the shaft portion 351, but less than an outer diameter of the head portion 352 of the fourth connecting pin 35.

Figure 4:
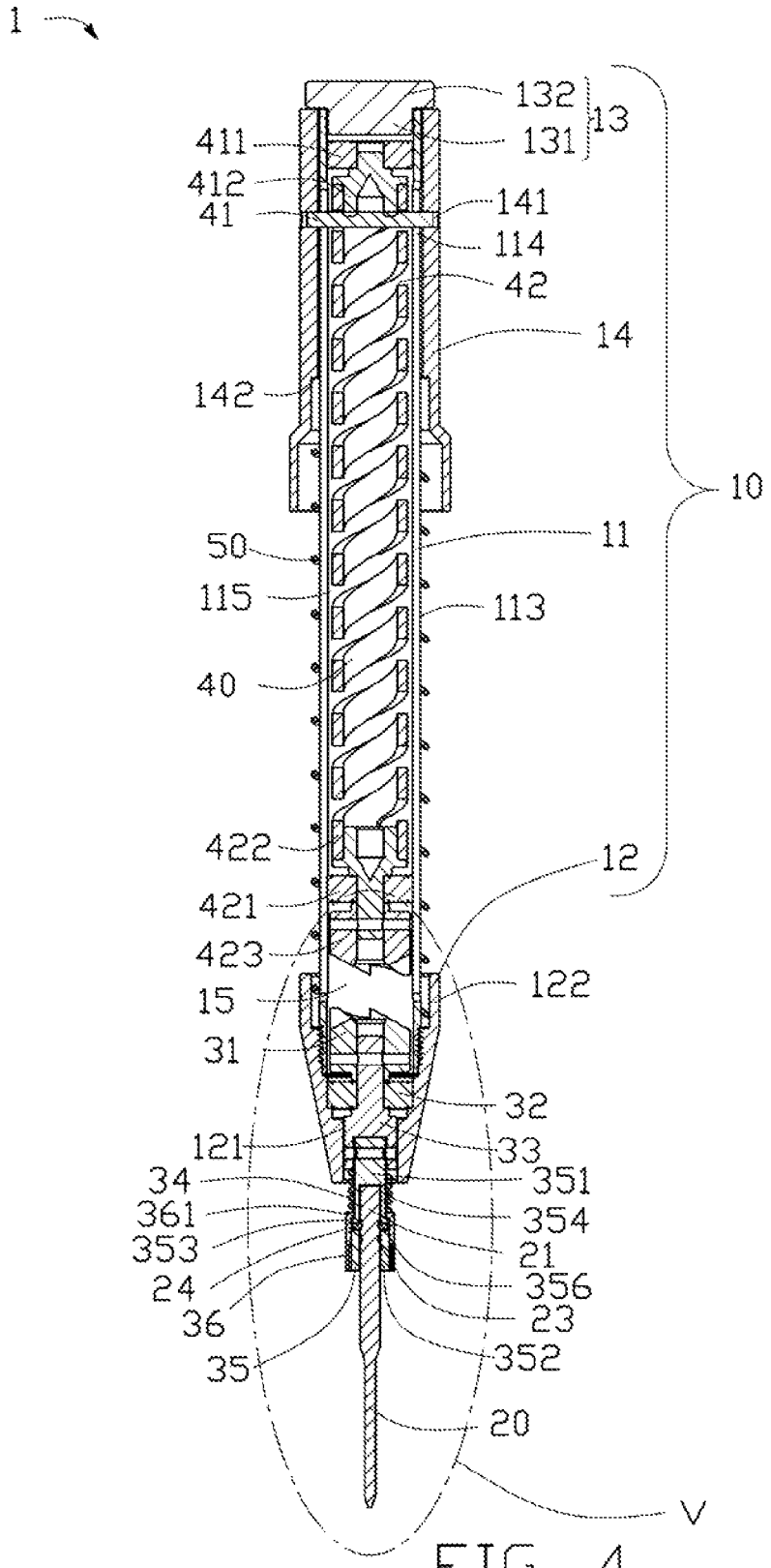
FIG. 4 is a cross sectional view of the manual screwdriver of FIG. 1, taken along line IV-IV thereof.
Figure 5:
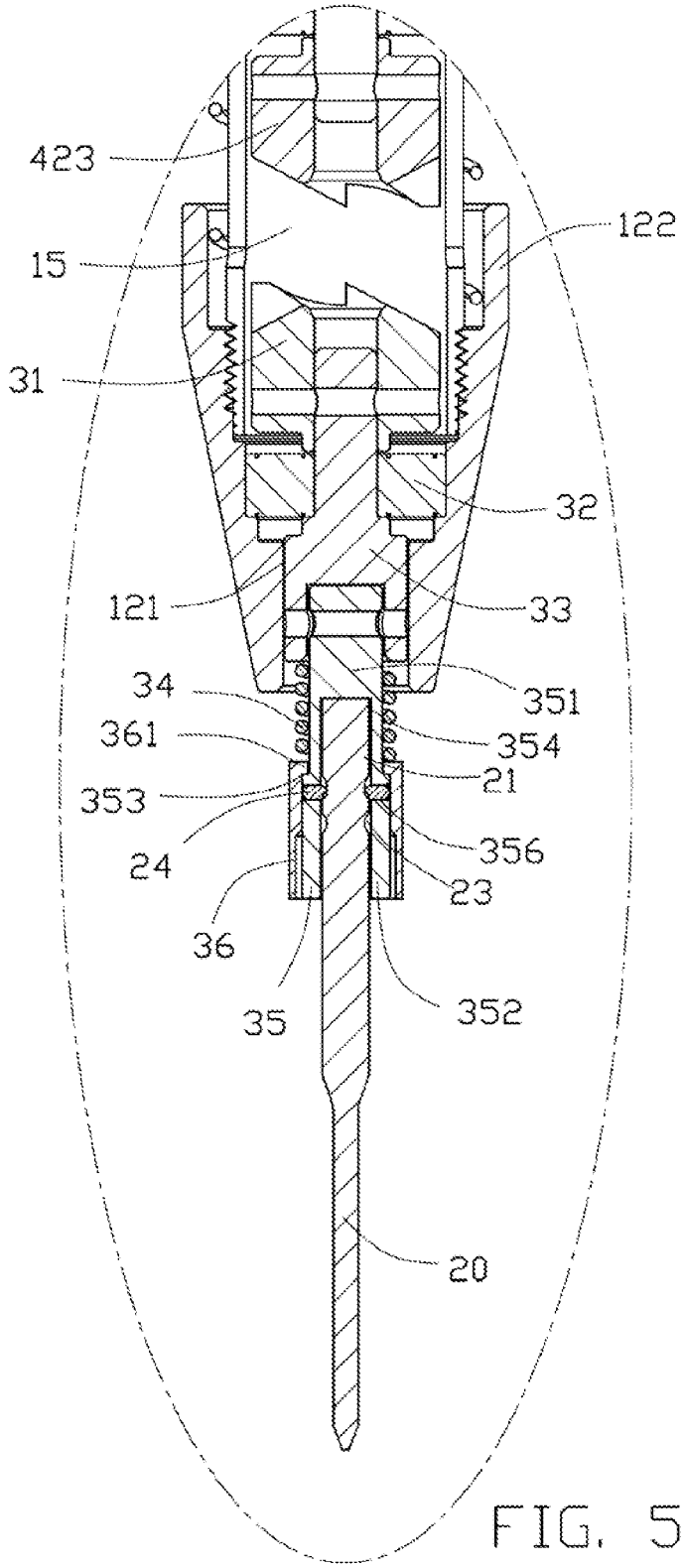
FIG. 5 is an enlarged view of part V of FIG. 4.

FIGS. 4 and 5 illustrate a cross sectional view of the manual screwdriver 1. When assembled, the end 21 of the screwdriver head 20 is inserted into the recess 354 of the fourth connecting pin 35 with two protruded ears 22 sliding into the two slits 355 of the recess 354 (see FIGS. 2 and 3). One of two recessed neck portions 23 is exposed through the two connecting holes 356. Two fasteners 24 are partially embedded into the two connecting holes 356, respectively. The snap ring 36 is sleeved onto the shaft portion 351 of the fourth connecting pin 35 and slides toward the head portion 352, until the baffle 361 is retained by the step 353 of the fourth connecting pin 35 and the two fasteners 24 are engaged between the recessed neck portion 23 of the screwdriver head 20 and an inner wall of the snap ring 36.

The second elastic element 34 is coupled to the shaft portion 351. The fourth connecting pin 35 is releasably connected to the third connecting pin 33 via screw bolt (not shown). The second elastic element 34 is engaged between the snap ring 36 and the third connecting pin 33. The snap ring 36 is held in position by the second elastic element 34. Accordingly, the screwdriver head 20 is releasably connected to the rotation connector 30.

The third bearing 32 and the first ratchet 31 are received into the through hole 121 of the cap 12, respectively. The third connecting pin 33 passes through the third bearing 32 to engage the first ratchet 31. Accordingly, the screwdriver head 20 is releasably connected to the cap 12 of the handle 10.

The first main body 11 is screwed onto the cap 12. The second ratchet 423, the second bearing 421 are sequentially connected to one of two ends of the spiral rod 40 via the second connecting pin 422. The first bearing 411 is connected to the other end of the spiral rod 40 via the first connecting pin 412. The spiral rod 40 together with the first bearing 411, the second bearing 421 and the second ratchet 423 are inserted into the cavity 115 of the first main body 11. The first elastic element 50 is coupled to the first main body 11. The bush 14 is sleeved onto the outer wall 113 of the first main body 11. The operating arm 41 sequentially passes through one of two insertion holes 141, one of two slots 114, the spiral groove 42, the other slot 114 and the other insertion hole 141 so as to interconnect the bush 14 and the spiral rod 40.

The bush 14 defines a step 142 at one end thereof. The first elastic element 50 is sleeved onto the first main body 11 and engaged between the cap 12 and the bush 14. Two opposite ends of the first elastic element 50 abuts against the barrier 122 of the cap 12 and the step 142 of the bush 14. In the present embodiment, the first elastic element 50 and the second elastic element 34 are compression springs.

Finally, the shaft portion 131 of the rear cover 13 is screwed onto the opening 112 of the first main body 11 with the enlarged head portion 132 covering an end of the first main body 11.

The cavity 15 is cooperatively defined by the cap 12, the first main body 11 and the rear cover 13.

Figure 6:
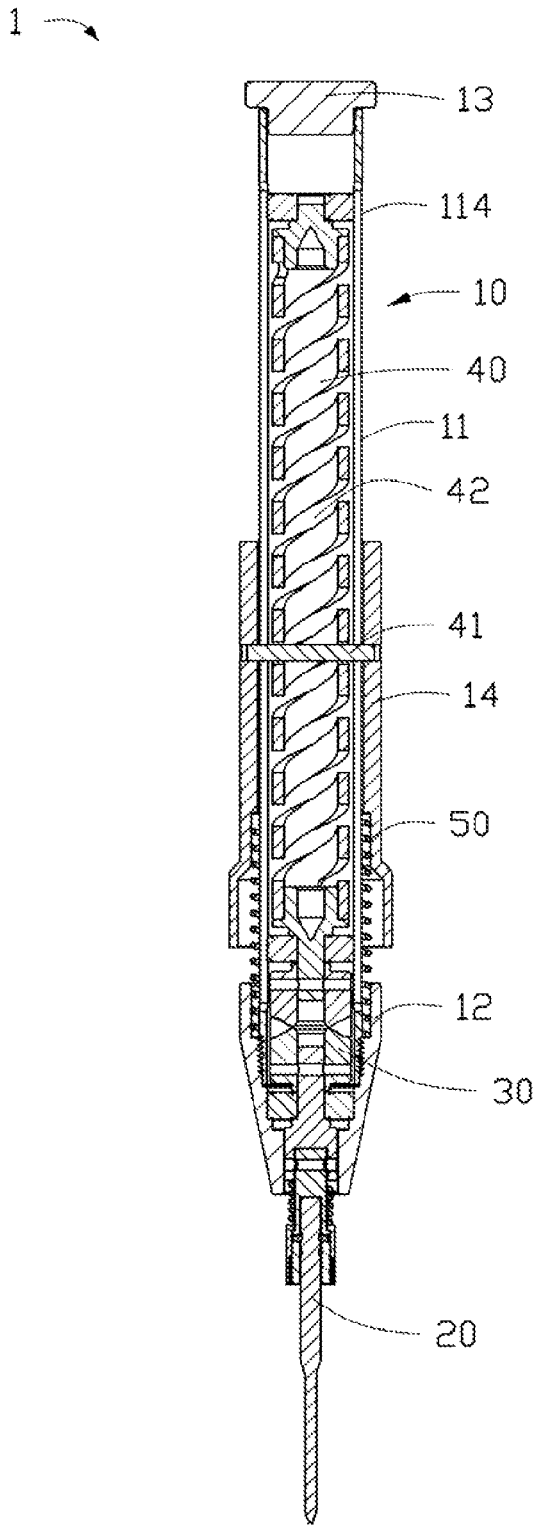
FIG. 6 is another cross sectional view of the manual screwdriver of FIG. 1.

FIG. 6 illustrates a cross sectional view of the manual screwdriver 1 when the spiral rod 40 and the rotation connector 30 are combined together into an engaged state.

In operation, the screwdriver head 20 engages the fastener such as screw bolt, and the user pushes the bush 14 to move toward the screwdriver head 20 along the first main body 11. The spiral rod 40 is driven by the operating arm 41 coupled to the bush 14 to contact and engage the rotation connector 30. The operating arm 41 slides in the spiral groove 42 toward the screwdriver head 20 to drive the spiral rod 40 and the rotation connector 30 to rotate in a clockwise direction about the axis X of rotation (see FIG. 1) relative to the handle 10, thereby enabling the screwdriver head 20 to synchronously and circularly rotate with the rotation connector 30.

When the operating arm 41 slides to the bottom edge of the slot 114, the bush 14 abuts against the cap 12, and the first elastic element 50 retained between the bush 14 and the cap 12 is compressed to its maximum to bias the bush 14 toward the rear cover 13. Once the force applied onto the bush 14 is withdrawn, the bush 14 is pushed away from the cap 12 by the first elastic element 50 to axially separate the spiral rod 40 from the rotation connector 30. The spiral rod 40 is driven by the first elastic element 50 to move toward the rear cover 13 and abut against the rear cover 13, and then the operating arm 41 slides in the spiral groove 42 toward the rear cover 13 to drive the spiral rod 40 to rotate in a counter clockwise direction about the axis X of rotation (see FIG. 1) relative to the handle 10 until the operating arm 41 slides to the top edge of the slot 114 to complete a work cycle.

In the present embodiment, by taking advantages of screw principle, a linear movement of the operating arm 41 in the slot 114 is converted into a rotation movement of the spiral rod 40 and the rotation connector 30, thereby enabling the screwdriver head 20 to synchronously and circularly rotate with the rotation connector 30. It is convenient and labor-saving for the user to operate the manual screwdriver 1. The spiral rod 40 is axially separated from the rotation connector 30 once the force applied onto the bush 14 is withdrawn, so as to prevent the spiral rod 40 and the rotation connector 30 from rotating counter-clockwise.

Referring to FIG. 4, different components of the manual screwdriver 1 are releasably combined together, so the manual screwdriver 1 can be assembled or disassembled with ease and efficiency. For example, when the screwdriver head 20 needs to be replaced, the user can push the snap ring 36 to move toward the third connecting pin 33 until the fasteners 24 is completely exposed out from the snap ring 36. Finally, the user can easily take out the fastener 24 and disengage the screwdriver head 20 from the handle 10.

In the present embodiment, the cap 12 and the rear cover 13 are separately molded and then releasably connected to opposite ends of the first main body 11. Alternatively, the cap 12 and the first main body 11 can be integrally formed as a single piece, and the rear cover 13 and the first main body 11 can also be integrally formed as a single piece.

The embodiments shown and described above are only examples. Many details are often found in the art such as the other features of manual screwdrivers. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. A manual screwdriver comprising:

a handle defining a cavity and a slot communicating the cavity to exterior space;

a screwdriver head at one end of the handle;

a rotation connector rotatably received in the cavity, the screwdriver head being coupled to the handle via the rotation connector;

a spiral rod defining a spiral groove and being rotatably received in the cavity;

an operating arm slidably received in the spiral groove with at least one end of the operating arm extending from the cavity through the slot;

a first elastic element, wherein the handle comprises a first main body and a cap releasably connected to one end of the first main body, the first elastic element is sleeved onto the first main body, the cap defines a barrier having an annular engaging surface extending radially outward from one of two ends of the cap, the handle further comprises a bush coupled to the operating arm, the bush is sleeved onto an outer wall of the first main body, the bush defines two insertion holes for receiving the at least one end of the operating arm extending from the cavity, and the first elastic element is engaged between the engaging surface of the barrier and the bush; and wherein the spiral rod can be driven by the operating arm to engage or disengage the rotation connector, and when the spiral rod and the rotation connector are combined together into an engaged state, the operating arm can slide toward the screwdriver head in the spiral groove to drive the spiral rod and the rotation connector to rotate about an axis of rotation with respect to the handle, thereby enabling the screwdriver head to synchronously and circularly rotate with the rotation connector.

2. The manual screwdriver of claim 1, further comprising a first ratchet on the rotation connector and a second ratchet at one end of the spiral rod, wherein the spiral rod and the rotation connector are brought into the engaged state by engaging the first ratchet with the second ratchet.

3. The manual screwdriver of claim 2, wherein each of the first ratchet and the second ratchet comprises a plurality of teeth, and the plurality of teeth of the first ratchet engage the plurality of teeth of the second ratchet to prevent sliding movement between the spiral rod and the rotation connector when the spiral rod and the rotation connector are brought into the engaged state.

4. The manual screwdriver of claim 2, wherein the rotation connector further comprises a third connecting pin and a fourth connecting pin releasably connected to the third connecting pin, the screwdriver head is coupled to the end of the fourth connecting pin away from the third connecting pin, and the first ratchet is coupled to the end of the third connecting pin away from the fourth connecting pin.

5. The manual screwdriver of claim 4, wherein the rotation connector further comprises a snap ring for securing the screwdriver head onto the fourth connecting pin and a second elastic element engaged between the snap ring and the third connecting pin.

6. The manual screwdriver of claim 5, wherein the fourth connecting pin comprises an elongated shaft portion and an enlarged head portion connected to the shaft portion, the snap ring is coupled to the head portion of the fourth connecting pin, and the second elastic element is coupled to the shaft portion of the fourth connecting pin.

7. The manual screwdriver of claim 6, wherein the fourth connecting pin defines a step between the shaft portion and the head portion, the snap ring defines an annular baffle extending radially inward from one end periphery thereof, and the snap ring is sleeved on the shaft portion of the fourth connecting pin with the baffle of the snap ring being held in position by the step of the fourth connecting pin.

8. The manual screwdriver of claim 6, wherein the head portion of the fourth connecting pin defines a recess for receiving one end of the screwdriver head.

9. The manual screwdriver of claim 8, wherein the screwdriver head has two protruded ears extending radial outward from the middle thereof, and the recess of the head portion of the fourth connecting pin defines two slits for respectively receiving the protruded ears of the screwdriver head.

10. The manual screwdriver of claim 8, wherein the screwdriver head defines two recessed neck portions at one of two ends thereof, and the head portion of the fourth connecting pin defines two connecting holes corresponding to one of the two neck portions of the screwdriver head.

11. The manual screwdriver of claim 10, wherein two fasteners are partially embedded into the two connecting holes, and the two fasteners are engaged between the one of two recessed neck portions of the screwdriver head and an inner wall of the snap ring.

12. The manual screwdriver of claim 1, wherein the slot is linear and extends along a direction parallel to the axis of rotation.

13. The manual screwdriver of claim 1, wherein the spiral groove spirally extends from one of two ends of the spiral rod toward the other end of the spiral rod the spiral groove.

14. The manual screwdriver of claim 13, wherein the spiral rod defines a channel therein, and the spiral groove surrounds the channel to be inclined to the axis of rotation.

15. The manual screwdriver of claim 1, wherein the first main body is tubular.

16. The manual screwdriver of claim 15, wherein the handle further comprises a rear cover releasably connected to the other end of the first main body.

* * * * *